US006513432B1

(12) United States Patent
Richter

(10) Patent No.: US 6,513,432 B1
(45) **Date of Patent: *Feb. 4, 2003**

(54) DEVICE FOR CLEANING A CYLINDER IN A PRINTING MACHINE

(75) Inventor: Ivo Richter, Heidelberg (DE)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/244,833

(22) Filed: Feb. 4, 1999

(30) Foreign Application Priority Data

Feb. 4, 1998 (DE) ..... 198 04 270

(51) Int. Cl.[7] ..... B41F 35/00

(52) U.S. Cl. ..... 101/425; 101/423; 15/256.52; 15/256.53

(58) Field of Search ..... 101/425, 423, 101/424; 15/256.53, 256.52, 256.51, 256.5, 179, 181–183, 151, 230, 230.16, 230.18, DIG. 5

(56) References Cited

U.S. PATENT DOCUMENTS

| | | | | | |
|---|---|---|---|---|---|
| 1,903,867 | A | * | 4/1933 | Lehmann | 15/DIG. 5 |
| 2,446,839 | A | * | 8/1948 | Lee | 15/256.51 |
| 2,575,635 | A | * | 11/1951 | Meyer et al. | 15/181 |
| 2,730,770 | A | * | 1/1956 | Higginbotham et al. | 15/256.52 |
| 4,015,307 | A | * | 4/1977 | Kossak | 101/425 |
| 4,361,922 | A | * | 12/1982 | Karal | 15/256.52 |
| 4,482,391 | A | * | 11/1984 | Pettingell et al. | 15/230.16 |
| 4,513,663 | A | | 4/1985 | Hummel | 101/349 |
| 4,953,463 | A | | 9/1990 | Hara | 101/425 |
| 5,386,608 | A | * | 2/1995 | Montabaur et al. | 15/230.16 |
| 5,408,930 | A | | 4/1995 | Loos | 101/425 |
| 6,006,391 | A | * | 12/1999 | Shurtliff et al. | 15/102 |
| 6,041,463 | A | * | 3/2000 | Stauch | 15/52.1 |
| 6,205,609 | B1 | * | 3/2001 | Sajakorpi et al. | 15/181 |

FOREIGN PATENT DOCUMENTS

| | | | | |
|---|---|---|---|---|
| CA | 1 270 147 | | 6/1990 | |
| DE | 25 07 179 | | 12/1975 | |
| DE | 36 29 825 | A1 | 3/1987 | |
| DE | 36 14 496 | A1 | 11/1987 | |
| DE | 42 09 642 | A1 | 9/1993 | |
| JP | 0093653 | * | 4/1988 | 15/230.14 |
| JP | 2-136240 | | 5/1990 | |

OTHER PUBLICATIONS

German Utility Model DE 295 16 976 U1, dated Feb. 8, 1996, washing apparatus for cleaning the cylinders of an offset press.

* cited by examiner

*Primary Examiner*—Andrew H. Hirshfeld
*Assistant Examiner*—Anthony H. Nguyen
(74) *Attorney, Agent, or Firm*—Laurence A. Greenberg; Werner H. Stemer; Ralph E. Locher

(57) ABSTRACT

A device for cleaning a cylinder in a printing machine, the cylinder having a jacket surface with at least one raised element, includes a cleaner engageable with the jacket surface of the cylinder and being rotatable about an axis of rotation for cleaning the jacket surface, the cleaner being formed with at least one recess through which the at least one raised element is able to pass.

21 Claims, 7 Drawing Sheets

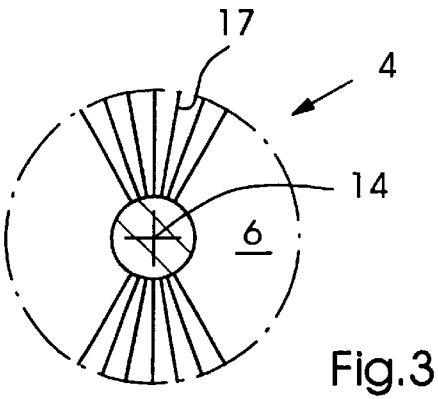
Fig.3
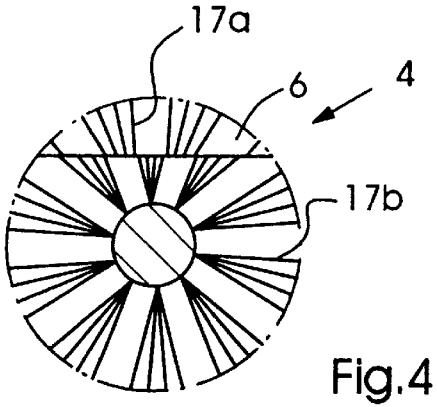
Fig.4
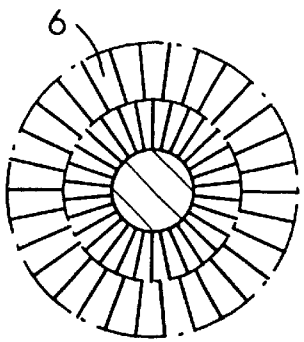
Fig.5
Fig.6
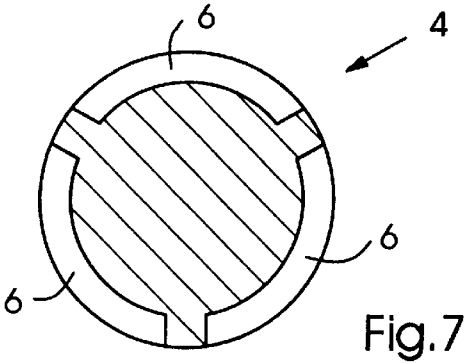
Fig.7
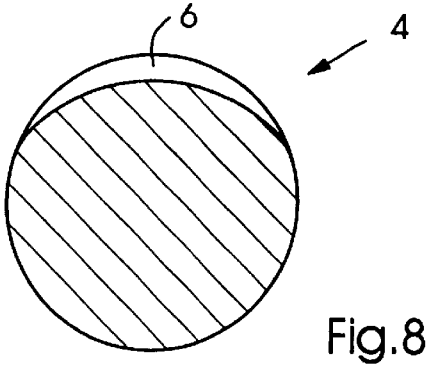
Fig.8

DEVICE FOR CLEANING A CYLINDER IN A PRINTING MACHINE

BACKGROUND OF THE INVENTION

FIELD OF THE INVENTION

The invention relates to a device for cleaning a cylinder in a printing machine, the cylinder having a jacket surface with at least one raised element, particularly at least one gripper for gripping a sheet of printing material, the cleaning device having a cleaner engageable with the jacket surface of the cylinder and being rotatable about an axis of rotation for cleaning the jacket surface.

Impression cylinders and sheet transfer drums installed in printing machines carry grippers which project beyond the periphery of the cylinder. The rotating cylinders are cleaned by cleaners in the form of cleaning rollers, cloths or brushes which can be brought into contact with the cylinders. In order to avoid damage to the cleaner by the grippers, precautions have to be taken.

The published German Utility Model Document DE 295 16 979 U1 describes a washing device for cleaning cylinders of an offset printing unit. The cylinders to be cleaned carry elevated grippers, and the cleaner is formed as a washing roller that rotates during cleaning. A control device is provided, by which the washing roller can be lifted away over rows of the grippers. With this washing device as the cleaner, it is possible to perform a more effective cleaning of the cylinder than with a cleaner in the form of a cloth. The rotation of the washing roller produces an increase in the relative movement between the surface to be cleaned and the cleaner. However, a lifting device is needed in order to lift the washing rollers over and beyond the rows of grippers, and thus a high outlay in terms of construction and control is necessary. The washing roller that is installed is not formed as a brush roller. The cleaning action is therefore lower, than with cleaners provided with brushes. Washing liquid which is sprayed on the washing roller is doctored off the latter by a wiper.

Furthermore, Japanese Patent 3-75348 describes a device for washing impression cylinders of an offset printing machine, in which the cleaner is in the form of a cloth which is pressable against the cylinders by two pressure plates. The pressure plates are formed with recesses which correspond to the grippers. One of the pressure plates is constructed so as to be laterally displaceable. The displacement of the one pressure plate occurs before it strikes the gripper and as a function of or in accordance with a signal transmitted by a detector that detects the grippers. The lateral displacement takes place alternately in two directions in order to compensate for the cloth slipping to one side on the pressure plates. Although the cleaner can be held in a position wherein it is in permanent or continuous contact with the rotating cylinder during the cleaning operation, effective cleaning of the cylinder is not possible with this device, because the relative movement between the cloth, which does not rotate during the cleaning operation, and the cylinder is produced only by the rotation of the cylinder. The cloth is not suitable for various types of soiling and surface structures of cylinders, in particular for removing paper particles stuck to a rough cylinder jacket surface. With this cloth pressed against the cylinder, the cleaning takes a comparatively long time in many cases, because the scouring action is low. Because the cloth does not have any cutout or recess through which the grippers can pass, it unavoidably becomes severely deformed, which reduces the cleaning quality.

SUMMARY OF THE INVENTION

It is accordingly an object of the invention to provide a device for cleaning a cylinder with a raised or elevated element in a printing machine, which is compact and of simple construction.

With the foregoing and other objects in view, there is provided, in accordance with one aspect of the invention, a device for cleaning a cylinder in a printing machine, the cylinder having a jacket surface with at least one raised element, the cleaning device comprising a cleaner engageable with the jacket surface of the cylinder and being rotatable about an axis of rotation for cleaning the jacket surface, the cleaner being formed with at least one recess through which the at least one raised element is able to pass.

In accordance with another feature of the invention, the cleaner is formed as a roller.

In accordance with a further feature of the invention, the roller is a brush roller.

In accordance with an added feature of the invention, the at least one recess extends in a circumferential direction of the cleaner over a circumferential angle less than 360°.

In accordance with an additional feature of the invention, the cleaner is formed as a roller, and the at least one recess is a single flat formed on the roller.

In accordance with yet another feature of the invention, the cleaning device includes a rotary drive for rotating the cleaner to match the rotation of the cylinder so that the at least one raised element passes contact-freely through the at least one recess.

In accordance with yet a further feature of the invention, the cleaning device includes a rotary drive for rotating the cleaner to match the rotation of the cylinder so that the at least one raised element passes without hindrance through the at least one recess.

In accordance with yet an added feature of the invention, the cleaner is nonuniformly rotatable while the at least one raised element passes through the at least one recess.

In accordance with yet an additional feature of the invention, the rotation of the cleaner is delayable while the at least one raised element is passable through the at least one recess.

In accordance with still another feature of the invention, the cleaning device includes a plurality of recesses extending in circumferential direction of the cleaner.

In accordance with still a further feature of the invention, the cleaner is formed as a roller, and each of the recesses is formed by an annular groove on the roller.

In accordance with still an added feature of the invention, the recesses extend in the circumferential direction of the cleaner over a circumferential angle of 360°.

In accordance with still an additional feature of the invention, the cleaning device includes an oscillatory drive for oscillating the cleaner parallel to the jacket surface of the cylinder In accordance with another feature of the invention, the cleaner is oscillatable axially by the oscillatory drive so that the raised element is passable through the recess without hindrance.

In accordance with a further feature of the invention, the cleaner is nonuniformly oscillatable.

In accordance with an added feature of the invention, the oscillations of the cleaner are delayable while the raised element is passable through the recess.

In accordance with an additional feature of the invention, the cleaning device includes at least one of a gear mechanism and an electronic control for matching the rotation of the cleaner to the rotation of the cylinder.

In accordance with yet another feature of the invention, the cleaning device includes at least one of a gear mechanism and an electronic control for matching the oscillations of the cleaner to the rotation of the cylinder.

In accordance with another aspect of the invention, there is provided a printing machine in combination with at least one cleaning device as defined hereinabove.

During the cleaning process, the cleaner can remain permanently or continuously in a position wherein it is in contact with the cylinder. This is achieved by shaping the cleaner so that it is matched to the elevated element or elements, each elevated element being assigned at least one recess corresponding thereto on the cleaner.

The cylinder may be a cylinder which carries a sheet of printing material in a gripper, which preferably forms the elevated element. A further type of elevation is represented by tools arranged on the cylinder jacket surface, for example stamping or cutting tools for processing the printing material in line in the printing machine. The cylinder may carry a number of elevated elements arranged in a row parallel to the axis of the cylinder, for example grippers forming a row of grippers. In this case, one recess may be assigned to a number of elevated elements which pass through this recess, or each recess may be assigned to a single elevated element.

The term recess is to be understood as, for example, a narrowed section, a channel, a flat, a depression or hollow, a bore, an eccentric or sickle-shaped turned section or a groove. In the case of a cleaning roller, the raised or elevated element or elements can enter the recess or recesses when the cleaning roller is rolling on the cylinder jacket surface. In the case of a cleaner that is formed as a roller, recesses shaped like segments of a circle or sectors of a circle, as viewed in the direction of the axis of the roller, may be provided. A brush roller may have, for example, four segment-like flats on the outer surface thereof, and a rectangular cross section. The cleaner may also have two cutouts shaped like sectors of a circle and, as viewed in the axial direction, may have the shape of a double brush.

The kinematics and geometry of the cleaner are preferably matched to the elevated elements so that the latter pass through the cleaner without contact by moving through or past the recess. Furthermore, in specific cases, provision may be made for the elevated elements to pass through the recess while making contact with the cleaner.

The cleaner may be formed as a roller or as a rotating brush. A cleaner that is formed as a roller may be covered with a fleece or may preferably be formed as a brush roller filled or studded with bristles. The cleaning action of a rotating cleaner filled with bristles is higher by comparison with devices of the aforementioned prior art. The roller may rotate in the same direction as the cylinder, giving, at the point of contact, an opposite relative movement of the roller outer surface or of the bristles in relation to the cylinder jacket surface, and a very good cleaning action. During the cleaning operation, the roller may rotate at a roller circumferential speed which is different from, in particular higher than, the cylinder circumferential speed. In this case, it is also possible for the roller and the cylinder to rotate in opposite directions.

The recess may extend in the circumferential direction or in the direction of rotation of the cleaner over a circumferential angle of 360° or more. A screw-like or helical recess extends over 360° or even more. However, a recess that extends over 360° is preferably formed as a self-contained annular groove. This construction is advantageous, in particular with regard to the rotary drive of the cleaning roller, which rotates continuously in this construction. To a row of elevated elements, for example the row of grippers, there may be assigned a number of annular grooves arranged so that they are offset in the direction of the cleaner axis.

The recess may extend over a circumferential angle of less than 360°. Such a recess is preferably formed as a flat that extends essentially over the entire width of a roller-like cleaner. This flat may extend over a number of elevated elements assigned to the recess, for example over all the grippers of a row of grippers. In this case, the outer surfaces close to the ends of the cleaning roller may form supporting regions which are not cut out.

A development of the cleaning device according to the invention may include the cleaner, in particular the cleaning roller, which is rotatable by a rotary drive to match the rotation of the cylinder so that the elevated element passes through the region of the recess without contacting the cleaner or with slight contact which does not damage the cleaner.

A further embodiment may include a control and/or gear mechanisms for ensuring a phase angle of a rotatable cleaner in relation to the phase angle of the rotating cylinder that the elevated element or elements can pass through the recess or recesses without hindrance. For example, the cleaner rotation that is driven by the rotary drive may take place nonuniformly and be suspended, in particular by delaying or retarding the rotation to the value zero, so that the cleaner is at a standstill when the elevated element passes through or past the recess. In addition to the described delay or retardation down to a standstill, i.e., a discontinuous rotation, a cleaner rotation at a nonuniform speed may also be provided in the form of an intermittent slow-down, so that by comparison with a uniform rotation there remains more time for the elevated element to pass through the recess, and the driving takes place particularly smoothly. Braking the cleaner rotation is advantageous, particularly in the case of a roller-like cleaner which has a single flat that is assigned to a number of elevated elements arranged in rows, for example the grippers.

According to a further development, the cleaner may be moved in a reciprocating manner parallel to the outer surface of the cylinder by a cleaner reciprocating drive. The cleaner reciprocating drive can be the drive to the printing machine, which displaces the cleaner laterally to and fro via a cleaner reciprocating mechanism. However, the cleaner may also have an oscillatory drive, for example an electric motor, assigned thereto, the electric motor being independent of the printing machine drive and being also capable of driving the cleaner via a cleaner reciprocating mechanism. The cleaner reciprocating drives and mechanisms which are used may be conventional distributor roller driving systems from inking units of printing machines, for example slider crank mechanisms and eccentric drives.

The lateral cleaner movement is periodic and corresponds in particular to a harmonic oscillation, for example to a sine or cosine function of the reciprocating travel as a function of the cylinder rotation. The cleaner, which constitutes a linear oscillator, oscillates to and fro between the two outer reversal locations, the speed decreasing as the reversal locations are approached. On this basis, one embodiment may provide for the elevated element or the elevated elements, during these movement phases close to or at the reversal locations, to pass through the recess or the recesses, in particular at least one recess shaped like an annular groove. The cleaner reaches the maximum speed in the central position, at an elongation with the value 0. In particular applications, it is beneficial for the elevated element to pass through the recess, for example the annular groove, precisely during this movement phase or in a movement phase remote from the reversal location. For these cases, provision may be made for the speed of the cleaner reciprocating movement to be reduced while the elevated element or elements pass through the recess or the recesses, it being possible for the cleaner reciprocating movement to be delayed or retarded down to a standstill. Following this stop or retardation, the cleaner is accelerated again. The movement function which results from the delay or retardation corresponds to a nonharmonic oscillation or nonuniform oscillation. In the case of a stop, there is also a discontinuous oscillation.

The device according to the invention can be used in rotary printing machines and, in particular, in sheet-fed rotary printing machines. Furthermore, the device can be used in machines which process printing material.

Other features which are considered as characteristic for the invention are set forth in the appended claims.

Although the invention is illustrated and described herein as embodied in a device for cleaning a cylinder in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 3 is a cross-sectional view of a third embodiment of the cleaner which is formed as a double brush;

FIG. 4 is view like that of FIG. 3 of a fourth embodiment of the cleaner which is formed as a brush roller having a groove-shaped recess therein;

FIG. 5 is another view like that of FIG. 3 of a fifth embodiment of the cleaner which is formed as a brush roller having an annular groove therein;

FIG. 6 is a cross-sectional view of a sixth embodiment of the cleaner which is formed as a cleaning roller having a shank;

FIG. 7 is a view like that of FIG. 6 of another embodiment of the cleaner formed as a cleaning roller formed with a plurality of recesses;

FIG. 8 is a view like that of FIG. 7 of a different embodiment of the cleaning roller which is formed with a sickle-shaped recess;

DESCRIPTION OF THE PREFERRED EMBODIMENTS

Figure 1:
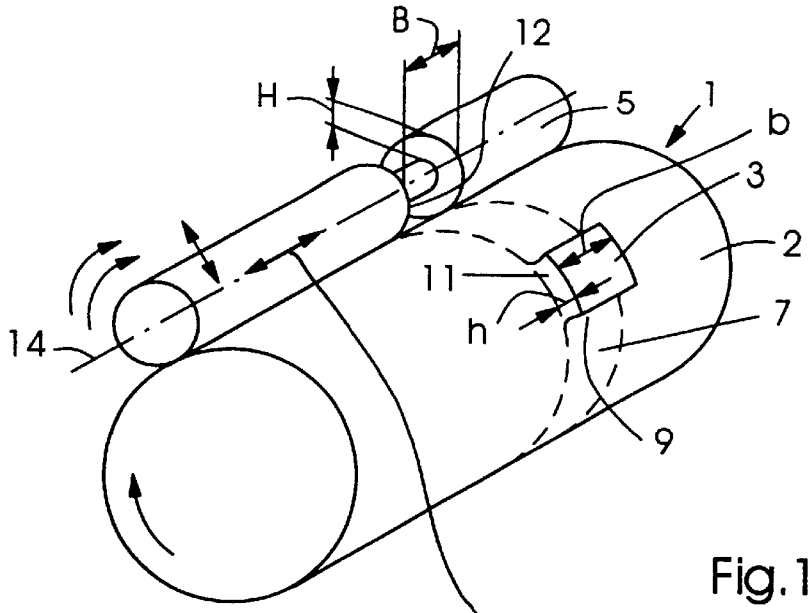
FIG. 1 is a diagrammatic perspective view of a device for cleaning a cylinder according to the invention, the device having a cleaner formed as a roller.

Parts corresponding to one another or functionally identical are identified by the same reference numeral in the various figures.

Referring now to the drawings and, first, particularly to FIG. 1 thereof, there is shown therein diagrammatically a device for cleaning a cylinder 1 that has a jacket surface 2 provided with a raised or elevated element 3, such as a stamp, for example, the cleaning device having a cleaner 4 that can be brought into contact with the jacket surface 2. The cleaner 4 is formed as a roller having a cleaner jacket surface 5 that can be brought into contact with the cylinder jacket surface 2 and is formed with a recess 6. During the cleaning of the cylinder 1, the cleaner 4 rotates about a rotational axis 14 thereof. The elevated element 3 is raised a height h with respect to an ideal circular cylinder contour, and extends over a width b in the direction of the rotational axis 14 of the cylinder 1. The shape of the recess 6 is matched to the elevated element 3, so that the latter can pass through the recess 6 without contact when the cleaner 4 is in the contact position with the cylinder 1, and the latter is rotating. This is achieved by providing an adequately large clearance or interspace between the outer contour of the cleaner 4 and that of the recess 6. For example, the height H of the recess 6 is 5 mm greater than the height h of the elevated element 3, and the width B of the recess 6 is 15 mm greater than the width b of the elevated element 6. The cleaner 4 can oscillate in the lateral direction, parallel to the axis of rotation of the cylinder. This avoids an uncleaned track from running around the circumference of the cylinder and from remaining in the region of the recess in the case wherein the cleaner 4 is non-oscillating. A reciprocating movement represented by the double-headed arrow 8 is performed so that the elongation and the position, respectively, of the recess 6 coincides exactly with the elevated element 3 in the lateral direction when the rotating cylinder 1 has an angle of rotation at which a front side 9 of the elevated element 6 is located a short distance in front of the cleaner 4. Several different embodiments, which can be realized under electronic control or by gear mechanisms, are possible with regard to an oscillation of the cleaner 4 that is dependent upon the cylinder rotation. A first different embodiment provides for the cleaner 4 to continue the reciprocating movement represented by the double-headed arrow 8 unchanged, i.e., to oscillate uniformly, while the elevated element 3 passes through the recess 6. The first different embodiment covers the following two modifications: the first modification is based upon a reciprocating movement represented by the double-headed arrow 8 at constant speed, for example a linear displacement driven by a pneumatic cylinder. This reciprocating movement corresponding to the double-headed arrow 8 remains constant while the elevated element 3 passes through the recess 6. The second modification is based upon a reciprocating movement represented by the double-headed arrow 8 that corresponds to a harmonic oscillation. This nonuniform reciprocating movement represented by the double-headed arrow 8 is continued in accordance with the function without any additional delay during the passage through the recess 6. While the elevated element 3 passes through the recess 6, in the case of the first different embodiment, a lateral displacement of the recess 6 occurs relative to the elevated element 3, the displacement travel covered during the passage through the recess 6 being, at the time when the elevated element 3 enters the recess 6, smaller than the distance between an outer side 11 of the elevated element 3 that is located in the respective current displacement direction and an inner side 12 of the recess 6, so that the inner side 12 does not strike the outer side 11.

A second different embodiment includes a braking of the reciprocating movement represented by the double-headed arrow 8, so that the cleaner 4 is slowed down, i.e., oscillates nonuniformly, while the elevated element 3 passes through the recess 6. Two modifications thereof are again thereby possible. The first modification includes having the cleaner 4, that was previously moving at constant speed, experience a delay. The second modification includes additionally delaying the cleaner 4, which has already been accelerated or delayed in accordance with the harmonic oscillation. After the elevated element 3 has passed through the recess 6, the cleaner 4 is accelerated again.

In a third different embodiment, the delay is so great that the cleaner 4 stops and suspends the reciprocating stroke thereof, respectively, while the elevated element 3 passes through the recess 6. It is of course possible for the construction described hereinabove to be applied to a plurality of elevated elements 3 arranged alongside one another, for example to a row of grippers, and to a plurality of recesses 6 corresponding thereto.

Figure 2:
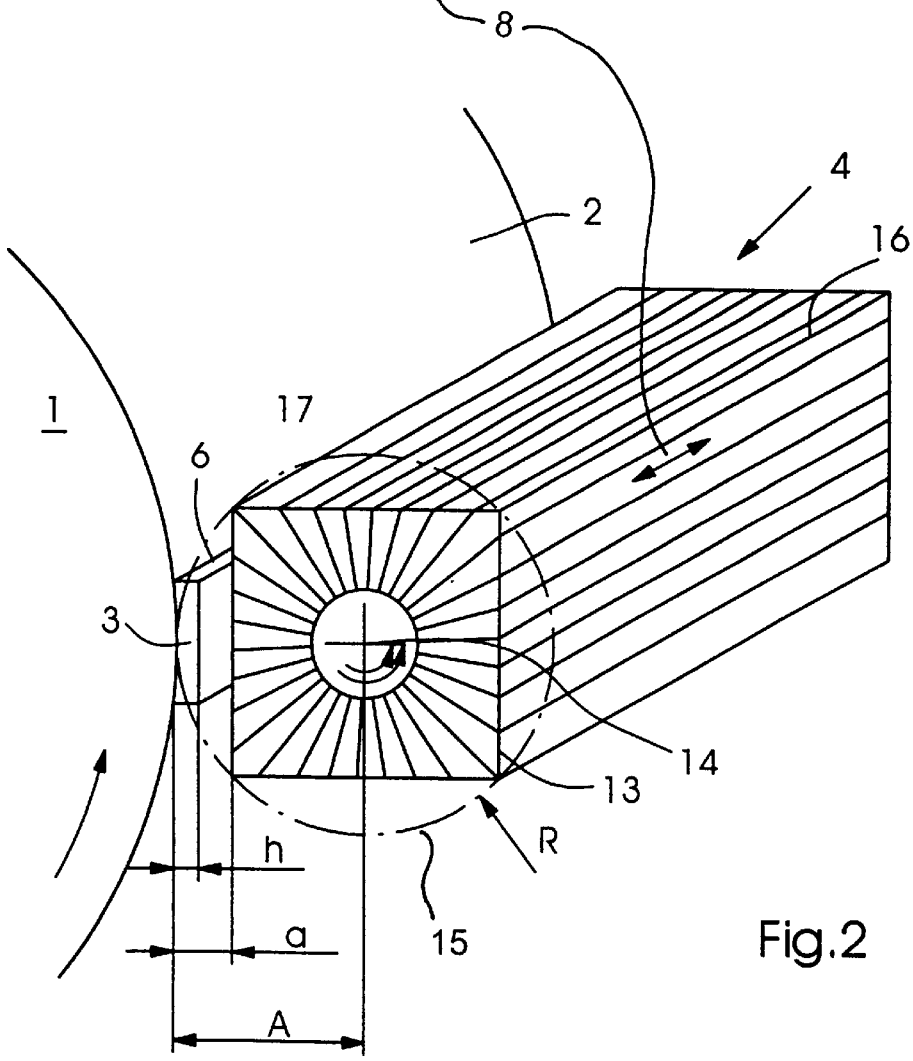
FIG. 2 is a diagrammatic perspective view of another embodiment of the cleaning device wherein the cleaner is formed of a brush roller having a rectangular cross section.

FIG. 2 shows a cleaner that is constructed as a brush roller having a polygonal and especially a square cross section. The axis of rotation 14 of the cleaner 4 is arranged at a radial distance A from the jacket surface 2 of the cylinder 1, a face 13 of the cleaner 4 facing towards the cylinder 1 being spaced a distance a therefrom and extending parallel to the tangential direction. The distance a is greater than the height h of the element 3, so that the latter is guided past the cleaner 4, which does not rotate or rotates very slowly during this process. The recesses 6, which are formed as flats, extend over the entire width of the cleaner 4 in the direction of the rotational axis 14, the recesses 6 in this embodiment resulting from the omission of bristles between the faces 13 and an imaginary circle 15 circumscribing edges 16 of the cleaner 4. The distance A is smaller than the radius R of the circumscribing circle 15, so that contact between bristles 17 and the jacket surface 2 of the cylinder 1, and a scouring action, are provided at corresponding rotary-angle settings or positions of the cylinder 1 and of the cleaner 4. When the element 3 has passed through the region of the recess 6, the rotational speed of the cleaner 4 is increased, for example by beginning to rotate the previously stationary cleaner 4 again. The cleaner 4 may rotate in the same direction of rotation as the cylinder 1, so that at the contact location an opposite relative movement between the cleaner 4 and the cylinder 1 is produced with a good scouring action. The cleaner 4 rotates at a speed which is significantly higher than the speed of the cylinder 1, so that each part of the jacket surface 2 to be cleaned is reliably reached and cleaned by the bristles and the edges 16. By appropriately selecting a speed ratio between the cylinder 1 and the cleaner 4 and/or an appropriate ratio between the periphery of the cylinder 1 and the periphery of the cleaner 4 or of the circumscribing circle 15, in conjunction with a given number of edges 16, an undesirable effect, namely that the edges 16 always come into contact with the same locations, can be eliminated. By an electronic control system and sensors, assurance can be offered that a recess 6 will always be aligned in the illustrated position with respect to the cylinder 1 when the element 3 is located a short distance in front of the cleaner 4, and remains in this position until the element 3 has left the region of the recess 6.

FIG. 3 shows a cleaner 4 that is formed as a brush roller and has circumferential regions with a bristle filling and circumferential regions without a bristle filling. As viewed in the direction of the rotational axis 14, the cleaner 4 is formed as a multiple brush and, in particular, as a double brush. In the case of the illustrated radially directed bristles 17, the recesses 6 are formed by bristle cutouts shaped like sectors of a circle.

FIG. 4 illustrates in a cross-sectional view a further embodiment of a cleaner 4 that is formed as a brush roller having a groove-like single recess 6 or a plurality of recesses 6 extending over a circumferential angle of less than 360°. The recess or recesses 6 extend over only part of the cleaner 4 in the direction of the axis of rotation thereof and form a flat which is enclosed on both sides by lateral walls, formed in FIG. 4 of the bristles 17*a*, the bristles 17*b* being shorter than the bristles 17*a*.

FIG. 5 illustrates a further cleaner 4 that differs from the cleaner 4 illustrated in FIG. 4 in that the one or all recesses 6 extend over a circumferential angle of 360° and are formed as annular grooves. The cleaner 4 is formed as a brush roller that is narrowed at one or more locations in the axial direction.

FIG. 6 illustrates in a sectional view of yet another cleaner 4 formed as a cleaning roller. The cleaner 4 does not have any bristles, but instead has, for example, a rough circumferential surface to which soil or dirt continues to adhere. The recess 6 is formed as a four-sided flat, so that a groove runs around a shaft, that is formed here as a square core.

FIG. 7 is a cross-sectional view of yet a further cleaner 4 that has a plurality of recesses 6 which lie on a circumferential line and form circumferential grooves.

FIG. 8 illustrates yet an added cleaner 4 formed with a sickle-shaped recess 6.

Figure 9:
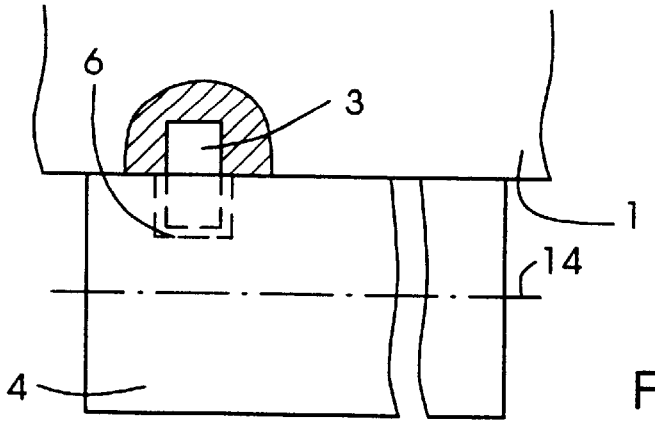
FIG. 9 is a fragmentary side elevational view of a cylinder, shown partly broken away and in section, in contact with a cleaning roller formed with a depression wherein an elevated element on the cylinder engages.

FIG. 9 illustrates how the elevated element 3 carried by the cylinder 1 enters the recess 6 formed as a depression, the cylinder 1 and the cleaner 4, which is formed as a roller, rolling on one another.

Figure 10:
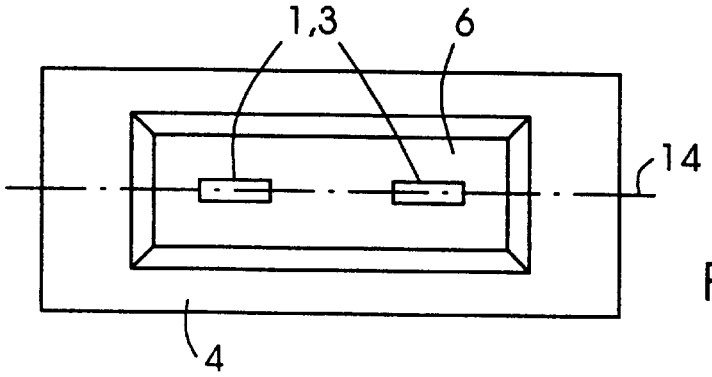
FIG. 10 is a side elevational view of a cleaning roller formed with a recess extending in the axial direction of the roller over a plurality of elevated elements disposed on a non-illustrated cylinder.

FIG. 10 is a plan view of a roller-shaped cleaner 4 formed with the recess 6, wherein a plurality of elevated elements 3 carried by the cylinder 1 enter the recess 6 in common at the same time.

Figure 11:
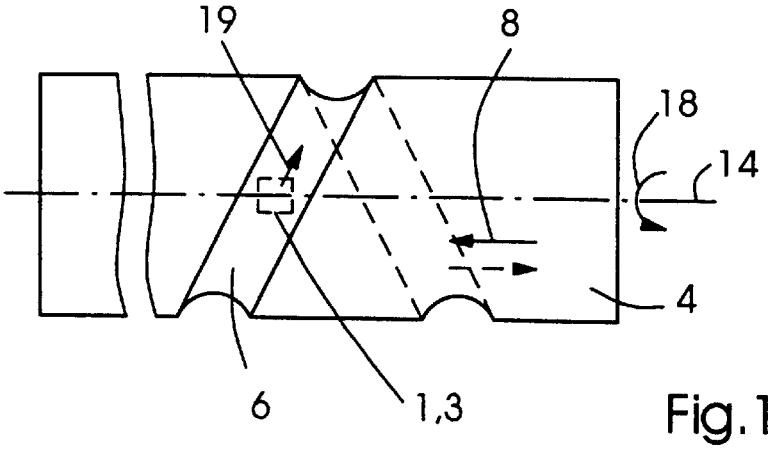
FIG. 11 is a side elevational view of another embodiment of the cleaning roller that is formed with an obliquely extending or inclined groove.

FIG. 11 shows a roller-shaped cleaner 4 having a recess 6 formed as a thread-shaped helical or spiral groove. A rotation represented by the curved arrow 18 and the reciprocating movement represented by the oppositely directed horizontal arrows 8 of the cleaner 4 are performed so as to match the rotation of the cylinder 1, so that the element 3 and the recess 6 execute a movement relative to one another represented by the inclined arrow 19, and the element 3 passes through the recess 6 in the process. In this different embodiment, the cleaner 4 oscillates without stopping. Instead of the spiral groove with a plurality of turns, the recess 6 may also be formed as a groove which runs obliquely, i.e., in a direction differing from the circumferential direction.

Figure 12:
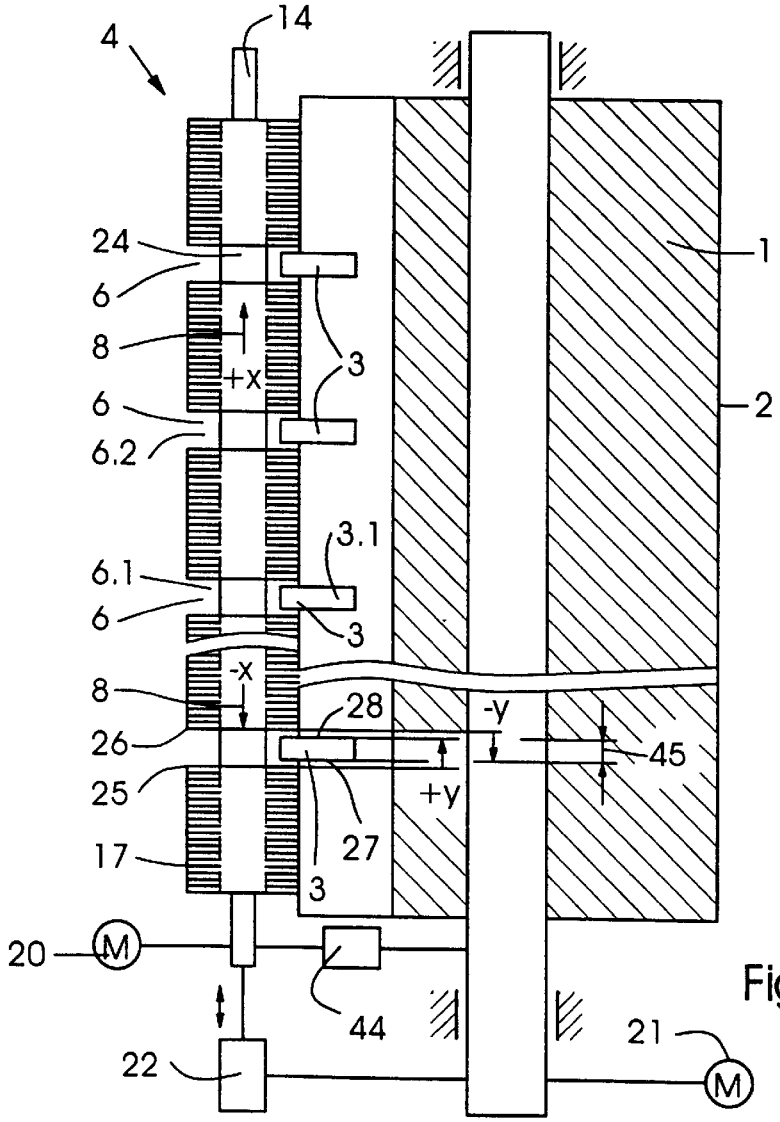
FIG. 12 is a diagrammatic and schematic longitudinal sectional view of the cleaning device according to the invention having a brush roller formed with annular grooves and cleaning a cylinder provided with grippers.

FIG. 12 illustrates a preferred embodiment of the inventive device, in which the cleaner 4 is formed as a brush roller having a shape that forms a counterpart to the elevated elements 3. The elements 3 are formed here as grippers for firmly clamping and holding a sheet of printing material, and are arranged on the cylinder 1 at a distance from one another in a row which is parallel to the axis of rotation of the cylinder 1. The cylinder 1 is rotatably mounted in the side walls of the printing machine and is rotationally driven by a drive 21. The cleaner 4 is likewise rotatably mounted in a nonillustrated frame or in non-illustrated lever arms, the cleaner 4 being bringable into and out of contact with the cylinder 1 by pivoting the lever arms or moving the frame, for example in the radial direction. The cleaner 4 is illustrated in a central position, relative to which the cleaner 4 executes a periodically oscillating reciprocating movement represented by the arrows 8 directed in the positive direction "X" and the negative direction "−X", this movement being driven by an oscillatory drive 22. The drives 20 and 21 may be electric motors. The drive 22 may be a cleaner-reciprocating mechanism which converts the rotational drive movement of the cylinder 1 by the drive 21 into a translatory reciprocating movement represented by the respective arrows 8 of the cleaner 4. For example, the oscillatory drive 22 may be formed as a slider crank mechanism. By coupling the translatory drive movement of the cleaner 4 with the rotational drive movement of the cylinder 1, it is particularly easy to match the reciprocating movement represented by the arrows 8 to the phase angle of the cylinder 1, so that the cleaner 4 is always located in the correct position in which the elevated elements 3 can pass through the recesses 6. However, it is equally possible for the oscillatory drive 22 to operate as a function of the rotation of the cylinder 1 by electronic control equipment, instead of via a mechanical coupling to the drive 21. Furthermore, it is possible to brake or to accelerate the rotation of the cylinder 1 during the cleaning operation, in order to correct any actual/desired positional deviations in the relative position of the elevated elements 3 to the recesses 6. The cleaner 4 is studded or arrayed with the bristles 17, the latter forming bristle rings which surround the core 24 and between which the recesses 6, which are shaped like annular grooves, are left free. The recesses 6 are of such size that, with respect to the cleaner 4, there is, both in the radial direction and in the axial direction, a spaced distance between each elevated element 3 and the inner faces defining the recess 6 assigned to the respective element 3 when the cleaner 4 is in the operating position. The reference symbols +Y and −Y represent the amplitude of the reciprocating movement represented by the arrows 8 in the positive and in the negative direction, respectively. As a rule, the amplitudes +Y and −Y will be of equal size. The magnitudes of the amplitudes +Y and −Y are such that an overlap 45 results. The magnitude of the amplitude +Y may, for example, be of a sufficient size that the edge 25 bounding the recess 6 is moved beyond the position of the side edge 28 of the elevated element 3. In a corresponding manner, the amplitude −Y may be of such a size that the edge 26 runs beyond the side edge 27 during the reciprocating movement represented by the arrows 8. The result thereof is that the outer surface 2 is cleaned without leaving streaks even in the region behind the elevated elements 3. At a high frequency of oscillation or a large number of strokes of the cleaner 4 for each revolution of the cylinder 1, optimum coverage of the entire outer surface 2 by the cleaner 4 within a short time, and thus particularly effective cleaning of the cylinder 1, is provided. Furthermore, the overlap may have the value ±0. It is preferable for the elements 3 to pass through one and the same recess 6 during each revolution of the cylinder 1. Furthermore, however, provision may also be made for an element 3.1 to pass through a first recess 6.1 during one cylinder revolution and to pass through a second recess 6.2 during a subsequent cylinder revolution. This variation is particularly expedient if the lateral reciprocating movement represented by the arrows 8 is performed very slowly, the cleaner 4 executing a full oscillation for each four revolutions of the cylinder 1, for example. In the event that the cylinder 1 carries a second row of elements 3, for example a second row of grippers arranged diametrically opposite the row of grippers which are illustrated, provision may be made for an elevated element 3 in the first row and an elevated element 3 in the second row to pass one and the same recess 6 in the course of the rotation of the cylinder 1. Of course, it is also possible for a number of devices according to the invention to be used for cleaning one and the same cylinder 1.

Figure 13:
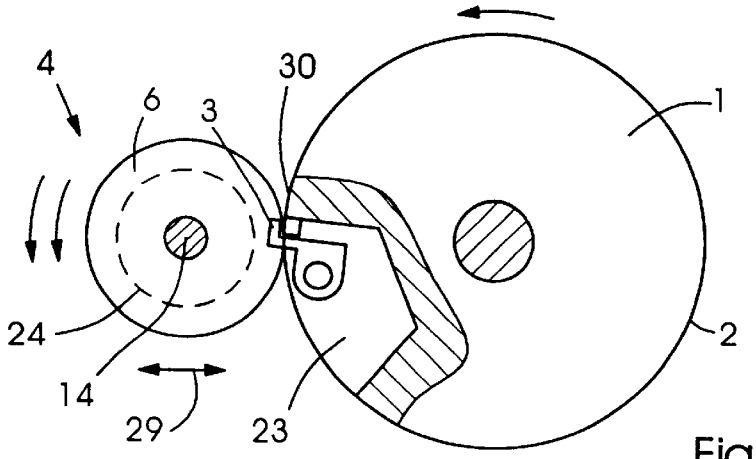
FIG. 13 is an end view of FIG. 12.

FIG. 13 is a side view of the device illustrated in FIG. 12. In contrast with the cleaning devices according to the prior art, the movement 29 into and out of contact is not necessary during each revolution of the cylinder 1. The cleaner 4 is brought into contact with the cylinder 1 before the cleaning process and remains in this operating position permanently or continuously during the entire cleaning process, i.e., over a large number of cylinder revolutions. After the cleaning process, the cleaner 4 is moved out of contact with the cylinder and put into a rest position. The elevated element 3 is arranged in the channel 23 and projects beyond the outer surface 2 and into the cleaner 4. The reciprocating action of the cleaner 4 is performed under control, so that the entire outer surface 2 located outside the channel 23, for example the printing area of an impression cylinder or the supporting face of a sheet transfer drum, is covered and cleaned by the cleaner 4. The sideways movement of the cleaner 4 comes to a standstill in the region of the channel 23 or when the elevated element 3 passes through the recess 6. As a result of the aforementioned variation of the rotational speed of the cylinder 1 in the case of an oscillatory drive 22 which operates independently of the rotary drive 21 and, in particular, as a result of a lower rotational speed of the cylinder when the printing start at 30 is being led past the cleaner 4, it is possible for the region behind the grippers which form the elevated elements 3 to be cleaned completely.

The cleaner 4 that is shown in FIGS. 12 and 13 essentially corresponds to the cleaner 4 shown in FIG. 5. Instead of this embodiment of the cleaner 4, other rotating brushes, in particular rotationally symmetrical brushes, and the cleaning rollers which are illustrated in FIGS. 6 and 11 may be used.

Figure 14:
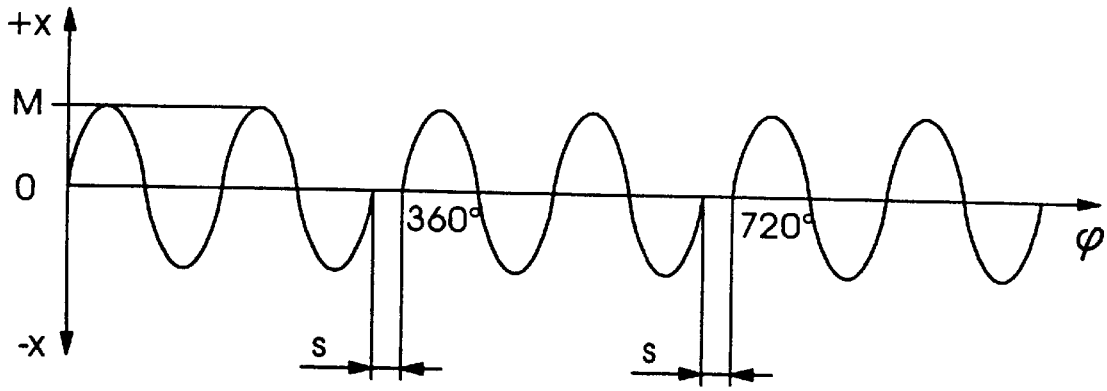
FIG. 14 is a plot diagram or graph of the course of movement of the brush roller shown in FIGS. 12 and 13.

FIG. 14 illustrates a distance/time graph that shows the various movement phases of the reciprocating movement represented by the arrows 8 of the cleaner 4 illustrated in FIGS. 12 and 13. The variable assigned to the x-axis of the coordinate system is the rotational position ϕ of the cylinder 1. The variable assigned to the y-axis is the elongation or lateral deflection of the cleaner 4 from the central position X=0. The cleaner 4 oscillates sinusoidally, the frequency of oscillation of the cleaner 4 being greater than the rotational frequency of the cylinder 1. In the illustrated example, the cleaner 4 executes two oscillations during one revolution of the cylinder 1. The curve begins at point 0 at a time at which the elevated elements 3 have just passed through the recesses 6. The two periods of the oscillation of the cleaner 4 are followed by a standstill phase S of the reciprocating movement represented by the arrows 8. During this stop, the cleaner 4 is in the central position again and the elevated elements 3 are passing through the recesses 6. The reciprocating movement represented by the arrows 8 is subsequently continued. The phases of movement and of standstill S are repeated periodically and alternately during the cleaning process, the cleaner 4 oscillating discontinuously. Furthermore, a reciprocating movement represented by the arrows 8 which is not coupled mechanically to the rotation of the cylinder 1 can be illustrated in a graph which corresponds exactly to that of FIG. 14, except that in this case the x-axis is implemented as a time axis.

Figure 15:
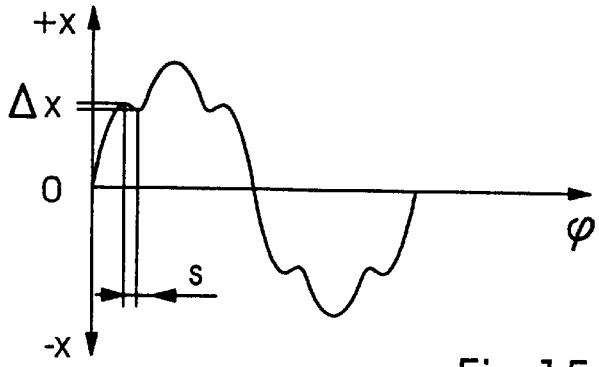
FIG. 15 is a further plot diagram of a cleaning movement.

FIG. 15 illustrates a further, nonharmonic variation of the oscillation of the cleaner 4. In this case, a number of harmonic oscillations are superimposed in drive terms, so that the result is an additional, intermittent delay of the reciprocating movement represented by the arrows 8, so that the cleaner 4 moves within the narrow region Δx. This slight lateral movement of the cleaner 4 means that it is virtually at a standstill s, during which the elevated elements 3 can pass through the recess 6.

Figure 16:
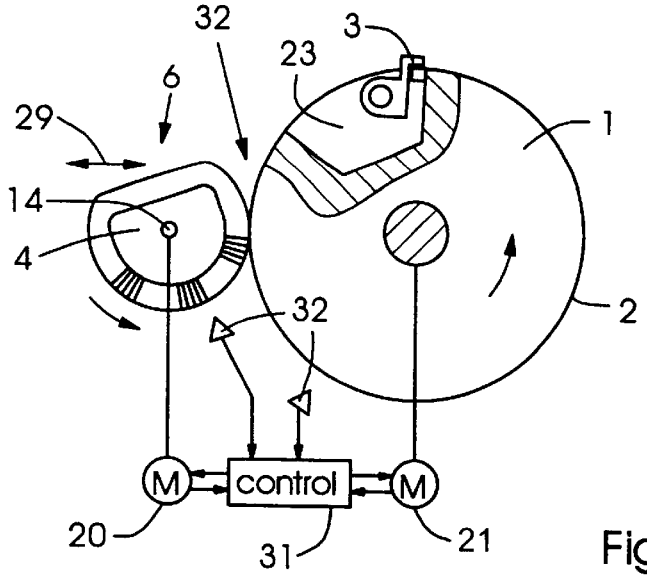
FIG. 16 is a diagrammatic and schematic end view like that of FIG. 13 of a further cleaning device according to the invention wherein a flattened brush roller cleans a cylinder having grippers.
Figure 17:
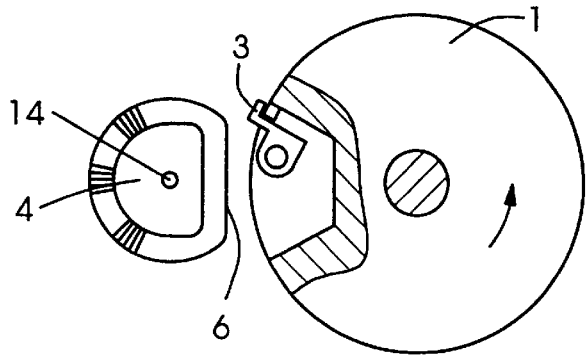
FIG. 17 is a view like that of FIG. 16 showing the device in a different operating phase thereof wherein the grippers are passing the flat of the brush.
Figure 18:
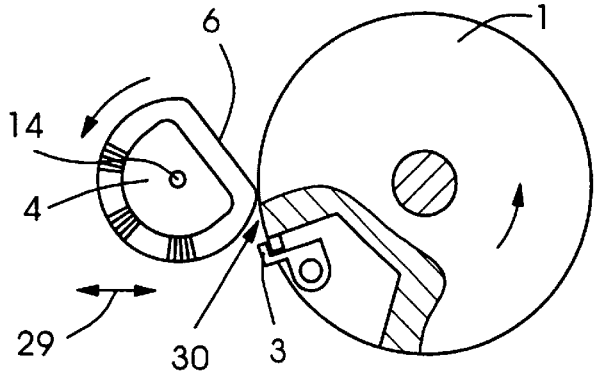
FIG. 18 is a view like those of FIGS. 16 and 17 showing the device in a further operating phase thereof wherein the cylinder is in a different rotational position.

FIGS. 16 to 18 show various movement phases in the case of a further embodiment of the cleaning device according to the invention, that are characterized by controlled braking of the rotation of the cleaner 4. The device illustrated in FIG. 16 has a cleaner 4 which is formed as a flattened brush roller, and a cylinder 1 that carries elevated elements 3 formed as grippers. The cleaner 4 and the cylinder 1 are mounted in the manner corresponding to that of the preceding exemplary embodiment. The cleaner 4 rotates about the rotational axis 14 during the cleaning process and can also oscillate laterally. In contrast with the previously described embodiment, lateral reciprocation is not necessary in order to cover the uncleaned streaks on the cylinder 1 which are caused by the shape of the cleaner 4. Instead, the cleaning action over the area may be made uniform and reinforced by a lateral oscillation. The cylinder 1 is rotationally driven by the drive 21, and the cleaner 4 is rotationally driven by the drive 20. The electronic control equipment 31 has a microprocessor and controls the drives 20 and 21 so that they are matched or adjusted to one another so that the recess 6 is always located in the position facing the cylinder (FIG. 17) when the elevated elements 3 are led past the cleaner 4. During this time interval, the cleaner 4 may be moved at a rotational speed that is lower than the rotational speed during the cleaning process, or may be halted at the correct angle, so that it remains in the position shown in FIG. 17 while the elements 3 pass through. Stopping the cleaner 4 at the correct angle in the position shown in FIG. 17 may be effected by a positively locking connection between a part assigned to the cleaner 4 and a part assigned to the cylinder 1. By a gear mechanism 44 (FIG. 12), for example a cam mechanism, it is possible to move the cleaner 4, after the standstill thereof, into an appropriate angular position, in which the rotational drive of the cleaner 4 starts up again. The cleaning process is performed, for example, as follows: first of all, the cleaner 4 is moved out of the rest position into the operating position, in which the non-recessed region of the cleaner 4 engages the outer surface 2. The cylinder 1 rotates at a comparatively slow rotational speed, and the cleaner drive 20 is active as long as the cleaner 4 is located over those regions of the circumferential surface 2 which are located outside the elevated elements 3 or the entire channel 23. At the printing end 32 (FIG. 16), the rotation of the cleaner 4 is stopped (FIG. 17), while the cylinder continues to rotate. After the elevated elements 3 have passed through the recess 6, the cleaner 4 begins to rotate again, so that the printing start 30 (FIG. 18) is well covered in the region behind the grippers. The cleaners 4 illustrated in FIGS. 2 to 4 and 7 to 10 can be used instead of the cleaner 4 illustrated in FIGS. 16 to 18. Furthermore, it is possible to allocate a number of cleaners 4 to the cylinder 1 for the purpose of simultaneous cleaning, it being possible, for example, to achieve a particularly thorough cleaning action by using two flattened cleaning rolls of different diameters. Of course, it is also readily possible to use the embodiment of the invention according to FIGS. 16 to 18 for cleaning cylinders having a plurality of rows of elevated elements. Furthermore, both the cleaner 4 illustrated in FIGS. 12 and 13 and the cleaner illustrated in FIGS. 16 to 18 may be driven by the drive 21 of the cylinder 1 via a gear mechanism 44.

Figure 19:
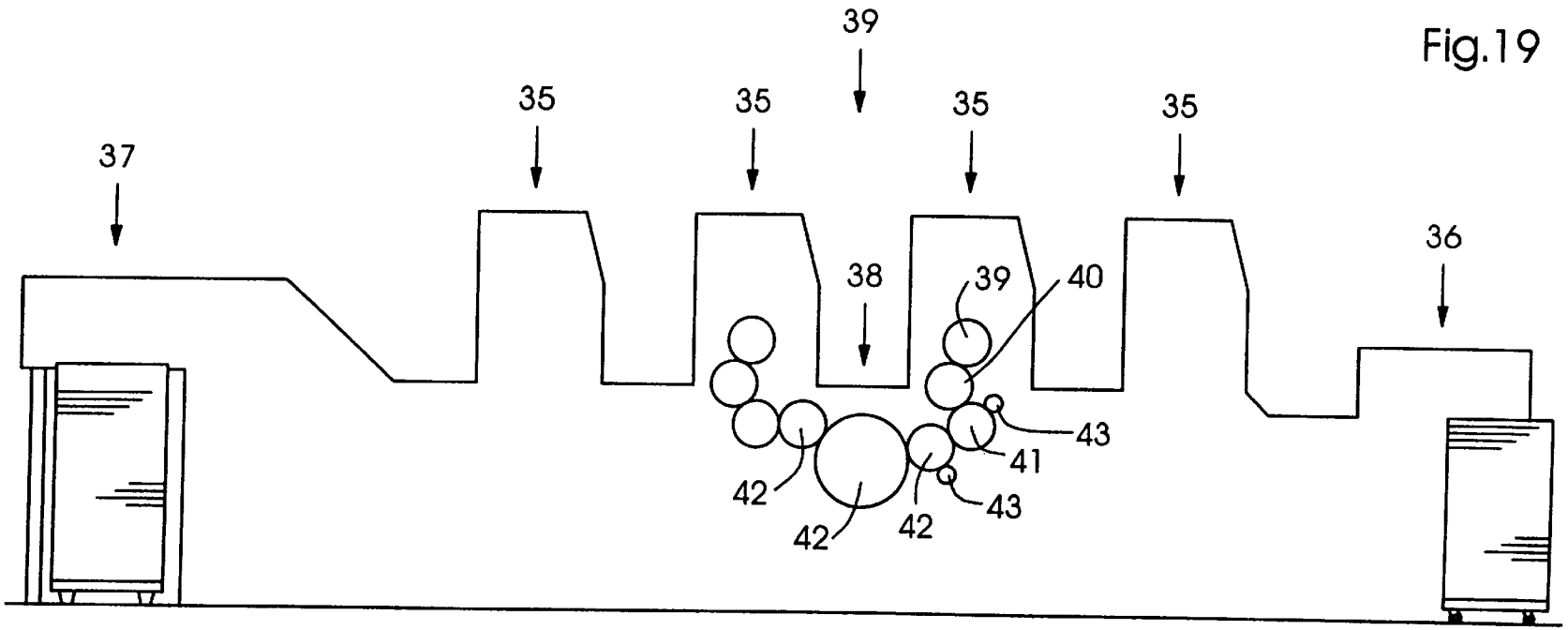
FIG. 19 is a diagrammatic side elevational view of a printing machine having a plurality of the cleaning devices according to the invention.

FIG. 19 illustrates a rotary printing machine 34, for example a sheet-fed rotary offset printing machine having printing units 35, a feeder 36, a delivery 37 and a reversing device 38 arranged between the printing units 35. Each printing unit 35 has a plate cylinder 39 and an impression cylinder 41 and may also have a blanket cylinder 40. The reversing device 38 has one or more sheet transfer drums 42. A cleaning device 43 according to the invention may be assigned to one or more of the cylinders 41 and 42 which carry one or more rows of grippers 3. The cleaning device 43 may also optionally be used for cleaning a plurality of, preferably two, cylinders 41 and 42, arranged adjacent to one another. For this purpose, the device 43 may be formed so as to pivot in a manner that it can be brought into contact with the plurality of cylinders 41 and 42. One preferred use of the device 43 is to clean the impression cylinder 41 and the sheet transfer drum 42 that is arranged directly downline of the impression cylinder 41 of the upline printing unit 35.

I claim:

1. A device for cleaning a cylinder in a printing machine, comprising:

a cleaner engageable with at least one raised element of a jacket surface of a cylinder in a printing machine and rotatable about an axis of rotation for cleaning the jacket surface, said cleaner having at least one recess and kinematics and geometry matched to the at least one raised element to allow the at least one raised element to pass through said at least one recess.

2. The cleaning device according to claim 1, wherein said cleaner is formed as a roller.

3. The cleaning device according to claim 2, wherein said roller is a brush roller.

4. The cleaning device according to claim 1, wherein said at least one recess extends in a circumferential direction of said cleaner over a circumferential angle less than 360°.

5. The cleaning device according to claim 4, wherein said cleaner is formed as a roller, and said at least one recess is a single flat surface formed on said roller.

6. The cleaning device according to claim 4, including a rotary drive for rotating said cleaner to match the rotation of the cylinder so that the at least one raised element passes contact-freely through said at least one recess.

7. The cleaning device according to claim 4, including a rotary drive for rotating said cleaner to match the rotation of the cylinder so that the at least one raised element passes without hindrance through said at least one recess.

8. The cleaning device according to claim 7, wherein said cleaner is to be nonuniformly rotated while the at least one raised element passes through said at least one recess.

9. The cleaning device according to claim 8, wherein said cleaner is to be rotatable delayed while the at least one raised element passes through said at least one recess.

10. The cleaning device according to claim 1, including a plurality of recesses extending in circumferential direction of said cleaner.

11. The cleaning device according to claim 10, wherein said cleaner is formed as a roller, and each of said recesses is formed by an annular groove on said roller.

12. The cleaning device according to claim 10, wherein said recesses extend in said circumferential direction of said cleaner over a circumferential angle of 360°.

13. The cleaning device according to claim 12, including an oscillatory drive for oscillating said cleaner parallel to the jacket surface of the cylinder.

14. The cleaning device according to claim 12, including an oscillatory drive for axially oscillating said cleaner parallel to the jacket surface of the cylinder so that the at least one raised element passes through said recesses without hindrance.

15. The cleaning device according to claim 14, wherein said oscillatory drive is to be nonuniformly oscillated for nonuniformly oscillating said cleaner.

16. The cleaning device according to claim 14, wherein said oscillatory drive is to be delayed for delaying the oscillations of said cleaner while the raised element passes through said recesses.

17. The cleaning device according to claim 7, including a control device for matching the rotation of said cleaner to the rotation of the cylinder.

18. The cleaning device according to claim 13, including a control device for matching the oscillation of said cleaner to the rotation of the cylinder.

19. In combination with a printing machines the cleaning device according to claim 1.

20. The cleaning device according to claim 1, wherein the cylinder includes a cylinder rotation axis and at least one printing form cylinder and said axis of rotation of said cleaner is disposed essentially parallel to said cylinder rotation axis.

21. A device for cleaning a cylinder in a printing machine, comprising:

a cleaner engageable with at least one raised element selected from a group consisting of grippers, tools, and stamps of a jacket surface of a cylinder in a printing machine and rotatable about an axis of rotation for cleaning the jacket surface, said cleaner having at least one recess and kinematics and geometry matched to the at least one raised element to allow the at least one raised element to pass through said at least one recess.

* * * * *